US012758067B2

(12) United States Patent
Zhong et al.

(10) Patent No.: US 12,758,067 B2
(45) Date of Patent: Oct. 13, 2026

(54) CLEANING TOOL AND CLEANING DEVICE

(71) Applicant: Beijing Roborock Technology Co., Ltd., Beijing (CN)

(72) Inventors: Kaifang Zhong, Beijing (CN); Qing Sun, Beijing (CN); Liang Qiao, Beijing (CN)

(73) Assignee: BEIJING ROBOROCK TECHNOLOGY CO., LTD., Beijing (CN)

( * ) Notice: Subject to any disclaimer, the term of this patent is extended or adjusted under 35 U.S.C. 154(b) by 279 days.

(21) Appl. No.: 18/003,389

(22) PCT Filed: Sep. 3, 2021

(86) PCT No.: PCT/CN2021/116368
§ 371 (c)(1),
(2) Date: Dec. 27, 2022

(87) PCT Pub. No.: WO2022/193567
PCT Pub. Date: Sep. 22, 2022

(65) Prior Publication Data

US 2023/0240490 A1 Aug. 3, 2023

(30) Foreign Application Priority Data

Mar. 16, 2021 (CN) ..... 202120541368.4

(51) Int. Cl.
*A47L 9/04* (2006.01)

(52) U.S. Cl.
CPC ..... *A47L 9/0411* (2013.01); *A47L 9/0477* (2013.01)

(58) Field of Classification Search
CPC .... A47L 9/0411; A47L 9/0477; A47L 9/0673; A47L 9/0666; A47L 9/02
(Continued)

(56) References Cited

U.S. PATENT DOCUMENTS 5,063,635 A * 11/1991 Ishii ..... A47L 9/0673 15/420
2010/0162515 A1* 7/2010 Stephens ..... A47L 9/325 15/323
(Continued)

FOREIGN PATENT DOCUMENTS

CN 101822507 A 9/2010
CN 106725102 A * 5/2017
(Continued)

OTHER PUBLICATIONS

Translation of CN106725102A (Year: 2024).*
English Translation of PCT/CN2021/116368 International Search Report dated Dec. 20, 2021.

*Primary Examiner* — Monica S Carter
*Assistant Examiner* — Sarah Akyaa Fordjour
(74) *Attorney, Agent, or Firm* — Calfee, Halter & Griswold LLP

(57) ABSTRACT

A cleaning tool, including a suction pipe, a brush head outer casing, a motor casing, and a brush head. The cleaning tool further includes: a brush head inner casing, which is relatively rotatably provided in the brush head outer casing and forms an accommodation cavity of the brush head; and a bottom plate, which is integrally formed with the brush head inner casing and forms a cleaning contact surface of the cleaning tool. The bottom plate includes a front raised portion and a rear raised portion.

18 Claims, 3 Drawing Sheets

(58) Field of Classification Search
USPC ..... 15/363
See application file for complete search history.

(56) References Cited

U.S. PATENT DOCUMENTS

| | | | | |
|---|---|---|---|---|
| 2010/0223753 | A1* | 9/2010 | Knox | A47L 5/26 15/363 |
| 2014/0137366 | A1* | 5/2014 | Elsdon | A47L 9/04 15/415.1 |

FOREIGN PATENT DOCUMENTS

| | | | |
|---|---|---|---|
| CN | 210300849 | U | 4/2020 |
| CN | 212089421 | U | 12/2020 |
| WO | 2020245561 | A1 | 12/2020 |

* cited by examiner

CLEANING TOOL AND CLEANING DEVICE

CROSS-REFERENCE TO RELATED APPLICATION

The present application is a US national phase of a PCT application under PCT/CN2021/116368, filed Sep. 3, 2021, which claims priority to Chinese Patent Application No. 202120541368.4, filed on Mar. 16, 2021, and entitled "CLEANING TOOL AND CLEANING DEVICE", the entire disclosure of which is incorporated herein by reference in its entirety.

TECHNICAL FIELD

The present disclosure relates to the field of cleaning device technologies, and in particular, relates to a cleaning brush head tool for a cleaning device.

BACKGROUND

Along with the social progress, automatic cleaning devices have appeared in thousands of households, bringing convenience resulting from high technology to the lives of more and more families.

Vacuum cleaners, in particular cordless/handheld vacuum cleaners, have played a significant role in making people's lives easy. However, different cleaning heads are required to achieve the desired cleaning effect for different scenarios to be cleaned.

SUMMARY

An object of the present disclosure is to provide a cleaning tool and a cleaning device, which can solve the technical problem of effective cleaning in certain cleaning scenarios. The specific solutions are as follows.

According to an aspect of the present disclosure, there is provided a cleaning tool. The cleaning tool includes a suction pipe, a brush head outer casing, a motor casing, and a brush head, where the cleaning tool further includes: a brush head inner casing, relatively rotatably provided within the brush head outer casing and forming an accommodation cavity of the brush head; a bottom plate, integrally formed with the brush head inner casing and forming a cleaning contact face of the cleaning tool; and, the bottom plate includes a front raised portion and a rear raised portion to facilitate movement of the cleaning tool on a cleaning surface.

In some embodiments, an end of the rear raised portion is provided with a rib to form a limit when the rear raised portion is rotated to be connected with the motor casing, where a shape of the rear raised portion is consistent with a shape of a corresponding portion of the motor casing.

In some embodiments, the cleaning tool further includes a driving member. The driving member is a tetragonal body, provided on an inner side of a side wall at an end of the brush head outer casing, and driven by a motor provided within the motor casing.

In some embodiments, the brush head includes a main body and a brush strip protruding outward from the main body, and an end of the main body is provided with a transmission port matching with the driving member, such that the driving member can effectively drive the brush head to rotate.

In some embodiments, an end of the brush head outer casing and a corresponding end of the brush head inner casing are each provided with a casing opening, such that the brush head is assembled and disassembled via the casing opening; and the brush head is locked in the casings by a locking knob via the casing opening.

In some embodiments, an operation portion of the locking knob protrudes from a side wall of the brush head outer casing.

In some embodiments, the brush head outer casing is provided with a front edge being flush with or above or slightly below a rotation axis of the brush head to provide a rotation space for the bottom plate; and when the front raised portion is rotated to be contacted with the brush head outer casing, the front edge forms a limit for the front raised portion.

In some embodiments, an air guide port is provided at a middle position of an upper portion of the brush head inner casing, and an opening span of the air guide port along a circumferential direction have no effect on suction efficiency of the suction pipe of the brush head outer casing when the brush head inner casing rotates relative to the brush head outer casing.

In some embodiments, an end of the suction pipe is provided with a connecting portion, and an electrical connector is provided on a periphery of the connecting portion.

According to another aspect of the present disclosure, there is provided a cleaning device. The cleaning device includes the cleaning tool defined as above.

BRIEF DESCRIPTION OF THE DRAWINGS

The accompanying drawings here are incorporated into the description and constitute a part of the description, showing embodiments conforming to the present disclosure, and are used together with the description to explain the principles of the present disclosure. Apparently, the accompanying drawings in the following description show only some embodiments of the present disclosure, and a person of ordinary skill in the art may derive other drawings from these accompanying drawings without creative efforts. In the accompanying drawings.

Figure 1:
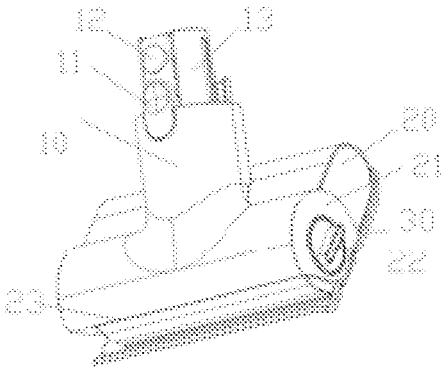
FIG. 1 is a stereoscopic view from a first perspective of a cleaning tool according to an embodiment of the present disclosure.

In the drawings, reference signs are as follows: 10, suction pipe; 11, button; 12, latch; 13, connecting portion; 14, electrical connector; 15, protective casing; 20, motor casing, 21, brush head outer casing; 22, locking knob; 23, front edge; 24, casing opening; 25, driving member; 26, rear edge; 30, bottom plate; 31, rib; 32, groove; 33, magnetic member; 34, brush head inner casing; 35, air guide port; 36, front raised portion; 37, rear raised portion; 40, brush head; 41, transmission port; 42, brush strip; and 43, rotating shaft.

DETAILED DESCRIPTION

To make the objectives, technical solutions and advantages of the present disclosure clearer, the present disclosure will be further described in detail below with reference to the accompanying drawings. It is obvious that the described embodiments are only part but not all of the embodiments of the present disclosure. All other embodiments obtained by those ordinary skilled in the art without creative efforts based on the embodiments in the present disclosure are within the protection scope of the present disclosure.

The terms used in the embodiments of the present disclosure are for the purpose of describing particular embodiments only and are not intended to limit the present disclosure. The singular forms "a/an", "said" and "the" used in the embodiments of the present disclosure and the appended claims are intended to include the plural forms as well, unless the context clearly indicates otherwise. The term "a plurality of" generally means including at least two.

It should be understood that although the terms first, second, third, etc. may be used for description in the embodiments of the present disclosure, these should not be limited to these terms. These terms are only used to distinguish from another. For example, "first" may also be referred to as "second" without departing from the scope of the embodiments of the present disclosure. Similarly, "second" may also be referred to as "first".

It should be noted that the terms "include," "contain," or any other variants are intended to cover the nonexclusive containing, such that the commodities or devices including a series of elements not only include those elements, but also include other unclearly listed elements, or also include the inherent elements of such commodities or devices. Without more limitations, the element defined by the phrase "including a . . . " does not exclude the existence of other same elements in the commodity or device that including such element.

The embodiments of the present disclosure will be described in detail below with reference to the accompanying drawings.

The cleaning tool according to the present disclosure is connected to a cleaning device for use. As shown in FIG. 1, the cleaning tool includes a suction pipe 10, a brush head outer casing 21, a motor casing 20, a brush head inner casing 34, a bottom plate 30, and a brush head 40.

For the convenience of description, the orientation of the brush head outer casing 21 on the cleaning tool is defined as the front, the orientation of the motor casing 20 is defined as the rear, the orientation of the bottom plate 30 is defined as the bottom, and the orientation of the suction pipe 10 is defined as the top.

One end of the suction pipe 10 is smoothly connected to the brush head outer casing 21 to form a suction channel for the cleaning tool; the other end of the suction pipe 10 includes a connecting portion 13 for connecting to the cleaning device; and a latch 12 and a button 11, for fixing the cleaning tool to the cleaning device, are provided on the connecting portion. When the connecting portion 13 is inserted into a corresponding opening on the cleaning device, the latch 12 is configured to lock the cleaning tool on the cleaning device; and when the button 11 is pressed, the latch 12 can be unlocked such that the cleaning tool can be removed from the cleaning device.

Figure 7:
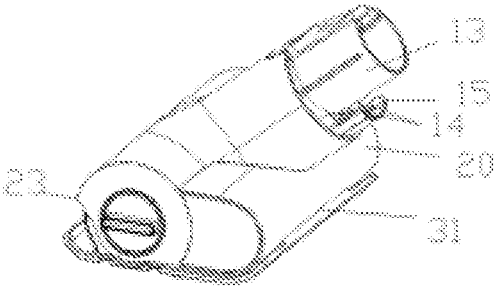
FIG. 7 is a stereoscopic view from a third perspective of a cleaning tool according to an embodiment of the present disclosure.

As shown in FIG. 7, an electrical connector 14 is provided on the side of the connecting portion 13 opposite to the latch 12, and is configured to correspond to a corresponding plug on the cleaning device. When the electrical connector 14 and the plug are interfaced, a power supply of the cleaning device may supply power to power-consuming parts on the cleaning tool. To protect the electrical connector 14 from being damaged, a protective casing 15 is provided on the periphery of the electrical connector 14, and may enclose the electrical connector 14. When the cleaning tool is placed alone, the electrical connector 14 is less liable to be touched by a foreign object due to the protective effect of the protective casing 15, which protects the electrical connector 14 against contamination on one hand and ensures that it will not be easily destroyed on the other hand.

Returning to FIG. 1, the brush head outer casing 21 is of a cylindrical configuration, with a rear end provided with the motor casing 20 and a front provided with a front edge 23. The front edge 23 acts as a cutting line of the brush head outer casing 21 along a cylindrical surface. When the bottom plate 30 is located on a cleaning surface and the motor casing 20 abuts against the rear of the bottom plate 30, the front edge 23 is flush with or above or slightly below a rotation axis of the brush head 40. The arrangement in such a way aims to expand a rotation angle of the brush head outer casing 21 relative to the brush head inner casing 34, such that when cleaning work is performed, a normal cleaning process would not be affected in the casing that a soft cleaning surface such as a bed sheet is rolled up by the cleaning tool. A rear end of the motor casing 20 is in the configuration of a semi-cylinder, and transversely spans the entire width of the cleaning tool, and the centerline of the semi-cylinder at the rear of the motor casing 20 is substantially flush with the centerline of the brush head outer casing (i.e., the rotation axis of the brush head).

Figure 2:
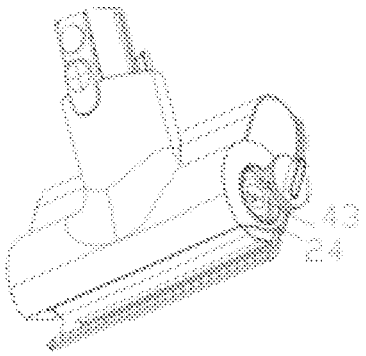
FIG. 2 is a stereoscopic view of a cleaning tool with a knob in an open state according to an embodiment of the present disclosure.

Referring to FIGS. 1-2, one side face of the brush head outer casing 21 is provided with a casing opening 24, which is formed as an opening for disassembling and assembling the brush head 40. After the brush head 40 is assembled into the casing via the casing opening 24, the casing opening 24 may be closed with a locking knob 22 to lock the brush head 40 within the casing. The locking knob 22 is a circular member matching with the casing opening 24, and is provided with a protruding operating portion along a straight direction of the locking knob 22, such that a user can perform a rotating operation on the locking knob 22 with, for example, the thumb and the index finger. After the locking knob 22 closes the casing opening 24, the operating portion also protrudes from the side face of the casing, such that no tools are required for operation.

Figure 10:
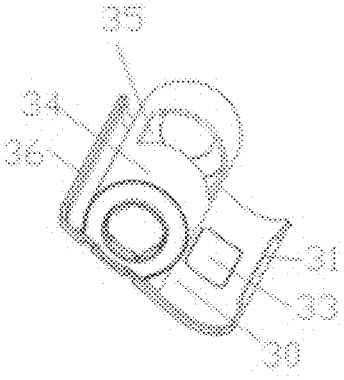
FIG. 10 is a stereoscopic view of a bottom plate of a cleaning tool according to an embodiment of the present disclosure.
Figure 11:
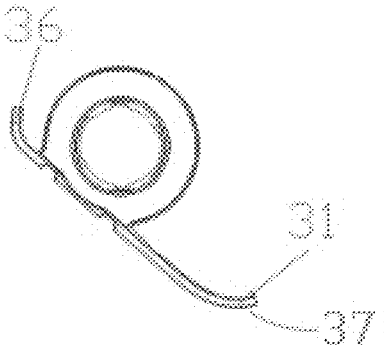
FIG. 11 is a side view of a bottom plate of a cleaning tool according to an embodiment of the present disclosure.

Referring to FIGS. 10-11, the brush head inner casing 34 and the bottom plate 30 are formed as an entirety, and the inner casing is also in the configuration of a cylinder, and is interfaced with the bottom plate 30 by a cutting plane. The cutting plane is located in the plane of the bottom plate 30 to jointly form a cleaning-surface contact face. A hollowed-out portion is formed in the cutting plane, and the brush head 40 provided in the casing protrudes out of the casing via the hollowed-out portion and is in interference contact with the cleaning surface for cleaning. The brush head inner casing 34 is accommodated within the brush head outer casing 21 on the whole, and the brush head inner casing and the brush head outer casing may rotate relative to each other around a rotating shaft 43, which is also the rotating shaft of the brush head 40.

Figure 4:
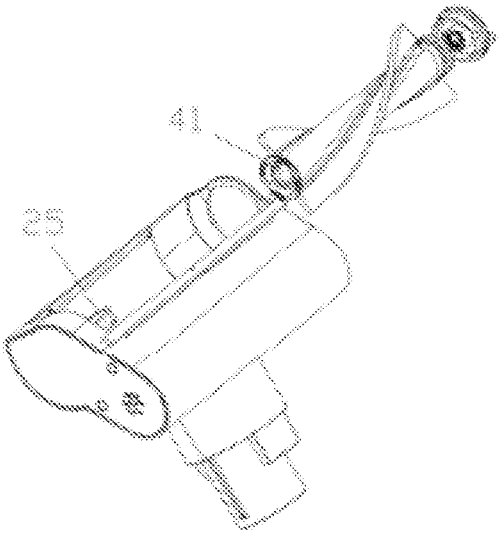
FIG. 4 is a stereoscopic view of a cleaning tool with a brush head in a withdrawn state according to an embodiment of the present disclosure.
Figure 5:
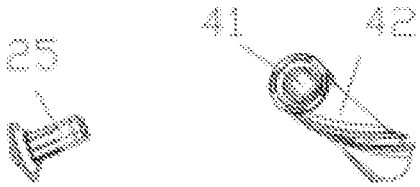
FIG. 5 is a schematic diagram of a transmission member of a brush head of a cleaning tool according to an embodiment of the present disclosure.

To realize the installation and movement of the above components, the brush head inner casing 34 and the brush head outer casing 21 are connected by suitable rotating pairs, for example, by shaft-hole rotating pairs at both ends. As shown in FIGS. 4-5, a driving member 25 is fixedly or detachably provided on an inner side wall at one end of the brush head inner casing 34, and one end of the driving member 25 is driven to rotate by means of a motor provided within the motor casing 20; and the other end of the driving member 25 is provided with a driving end in the shape of a tetragonal body. A transmission port 41 adapted to the above form of driving end is also provided on an axis at one side of the brush head 40. When the driving end extends into the transmission port 41, the rotation of the driving member 25 may drive the brush head 40 to rotate, thereby implementing cleaning. It can be understood that the specific configuration of the driving end can be in other forms as long as driving can be effectively realized without easily occurred thread slipping and failure, which is not particularly limited here. The other end of the brush head 40 and the inner side wall of the locking knob 22 are correspondingly provided with structural members for supporting rotation. For example, a support bearing is provided at the center of the inner side wall of the locking knob 22, such that the movement of the brush head 40 can be limited to rotation only along the rotating shaft 43 without jumping off the rotation axis.

Returning to FIGS. 10-11 again, a portion of a circumferential casing of the brush head inner casing 34 is interfaced with an inlet of the suction pipe 10. With reference to FIG. 2, it can be seen that wastes entering the casing from the hollowed-out portion of the cutting plane at the bottom of the brush head inner casing 34 need to pass through the inner casing 34 to enter the inlet of the suction pipe 10. Therefore, the circumferential casing is provided with an air guide port 35. Due to the relative rotation between the brush head inner and outer casings, the air guide port 35 has an area greater than an area of the inlet of the suction pipe 10, so as to ensure that the suction efficiency is not affected due to the inlet of the suction pipe 10 being covered by the circumferential casing of the brush head inner casing 34 at limiting positions of rotation of the inner and outer casings on both sides. Specifically, a front opening edge of the air guide port 35 is configured such that when the front edge of the brush head outer casing 21 abuts against the bottom plate 30, a front edge of the inlet of the suction pipe 10 is at least flush with or does not forwards exceed the front opening edge; a rear opening edge of the air guide port 35 is configured such that when the rear portion of the motor casing 20 abuts against a rib 31 provided on the bottom plate 30, a rear edge of the inlet of the suction pipe 10 is at least flush with or does not backwards exceed the rear opening edge; and left and right opening edges of the air guide port 35 exceed left and right boundaries of the inlet of the suction duct 10 leftwards and rightwards, respectively. Briefly speaking, the inlet of the suction pipe 10 is not blocked by the brush head inner casing 34 under any circumstances.

Figure 9:
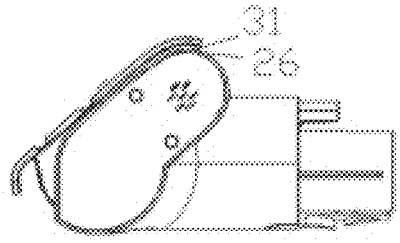
FIG. 9 is a side view of a cleaning tool according to an embodiment of the present disclosure.

The bottom plate 30 is a contact face with the cleaning surface when the cleaning tool is working. As mentioned above, in order to prevent a soft cleaning surface such as a bed sheet from being rolled up during cleaning, the front portion and the rear portion of the bottom plate 30 are each provided with a raised portion. Referring to FIGS. 9-11, a certain transverse position of the front raised portion 36 corresponds to the front edge 23 of the brush head outer casing 21, to form a rotation limit when the inner and outer casings rotate to one of the limiting positions. The certain transverse position may be at any position between a raising start position and a raising stop position of the front raised portion 36. The rear raised portion 37 has a raising shape that is consistent with a curved shape (a cylindrical shape in the present disclosure) of the motor casing 20, and a rib 31 across the width of the brush head is provided at an end of the rear raised portion 37 to form a limit when the inner and outer casings rotate to another limit position. When the limiting position is reached, the rib 31 abuts against the rear edge 26 on the brush head outer casing 21. As such, limiting members formed by the front edge 23 on the brush bead outer casing 21 and the rib 31 on the brush head inner casing 34 are respectively formed. The inner and outer casings may be rotated between the two limiting positions according to a working state, thereby achieving smoothness in operation for different cleaning surfaces and different angles.

Figure 3:
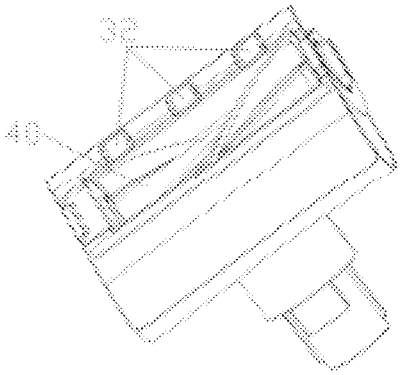
FIG. 3 is a stereoscopic view from a second perspective of a cleaning tool according to an embodiment of the present disclosure.

A plurality of grooves 32 are provided at a combination position of a flat bottom face of the bottom plate 30 with the front raised portion 36. Referring to FIG. 3, when the bottom plate 30 is attached to the cleaning surface, the plurality of grooves allows a brush head accommodation cavity, at which the hollowed-out portion of the bottom plate 30 is located, to be communicated with the external space. Moreover, the grooves 32 are provided at such a position that floating dust in a front region to be cleaned, which has not been cleaned by the cleaning tool, can be sucked into the suction pipe conveniently, and the situation that a locked-rotor effect is created by significantly reduced air pressure in a brush head cavity due to excessive attachment between the soft surface to be cleaned and the bottom plate 30 can be mitigated.

Figure 6:
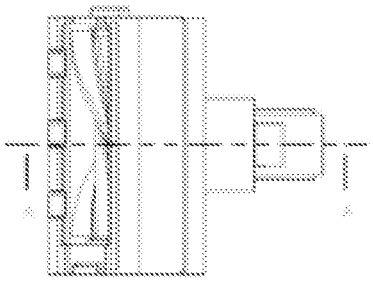
FIG. 6 is a bottom view of a cleaning tool according to an embodiment of the present disclosure.
Figure 8:
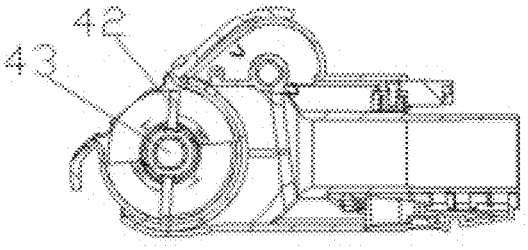
FIG. 8 is a longitudinal sectional view of a cleaning tool according to an embodiment of the present disclosure.

FIG. 6 shows a bottom view of the cleaning tool, and FIG. 8 is a sectional view taken along a line A-A in FIG. 6. From FIG. 8, it can be seen that the axes of the brush head 40, the brush head inner casing 34, and the brush head outer casing 21 are coaxial; the rotating shaft 43 is the rotating shaft of the brush head 40; and a brush strip 42 is provided radially outward from the rotating shaft of the brush head 40. Referring to FIG. 3, the brush strip 42 transversely spans the entire brush head and is arranged in a spiral shape. Preferably, two penetrating brush strips 42 may be provided. It can be understood that the configuration with more than two brush strips is also allowed, which is not limited in the present disclosure. The brush strip 42 may be in the form of a flexible soft rubber strip, or a hard bristle strip. The hard bristle brush is preferred since the main application scenarios of the cleaning tool include soft cleaning surfaces such as beds and sofas. The hard bristle brush is more efficient to clean up hair, floating dust and the like adhering to the above cleaning surfaces.

Referring to FIG. 10, the bottom plate 30 may also be provided with one or more magnetic members 33, by which the cleaning tool can be conveniently stored in an adsorption support frame, or in certain specific occasions presenting mutual adsorption with the magnetic member 33. After the cleaning work is completed, the cleaning tool can be stored simply by aligning the cleaning tool with another adsorption member, which is more convenient than a traditional support frame in which a corresponding storage space is provided.

According to the cleaning tool of the present disclosure, the reduction of transmission efficiency caused by thread slipping during a transmission process is avoided through a square transmission structure; meanwhile, the rib provided on the edge of the rear raised portion 37 of the bottom plate and the edge provided on the front of the brush head outer casing can implement front and rear limits for the bottom plate during the rotation process of the brush head inner casing and brush head outer casing; and the locking knob protruding from the side wall of the brush head outer casing can facilitate the operation of a user, thereby avoiding the situation that the brush head cannot be assembled and disassembled due to lack of tools at hand.

According to some embodiments of the present disclosure, there is further provided a cleaning device. The cleaning device include a fan, a separation mechanism, a power supply, etc., and also include a connector corresponding to the connecting portion 13 of the cleaning tool in the above embodiments, and a power-supply electrode corresponding to the electrical connector 14 of the cleaning tool, thereby achieving mutual matching during use.

Finally, it should be noted that the various embodiments in the description are described in a progressive manner, each embodiment focuses on the differences from the other embodiments, and the same or similar parts among the various embodiments may refer to one another. For the system or device disclosed in the embodiments, since it corresponds to the method disclosed in the embodiments, the description is relatively simple, and the relevant parts may refer to the description of the method section.

The above embodiments are only used to illustrate the technical solutions of the present disclosure and are not intended to limit the present disclosure. Although the present disclosure has been described in detail with reference to the foregoing embodiments, those of ordinary skill in the art should understand that: they can still make modifications to the technical solutions described in the foregoing embodiments, or make equivalent substitutions to some of the technical features; and these modifications or substitutions do not deviate the nature of the corresponding technical solutions from the spirit and scope of the technical solutions of the various embodiments of the present disclosure.

What is claimed is:

1. A cleaning tool, comprising a suction pipe, a brush head outer casing, a motor casing, and a brush head, wherein the cleaning tool further comprises:

a brush head inner casing, relatively rotatably provided within the brush head outer casing and forming an accommodation cavity of the brush head; and a bottom plate, integrally formed with the brush head inner casing and forming a cleaning contact face of the cleaning tool; wherein the bottom plate comprises a front raised portion and a rear raised portion;

an end of the rear raised portion is provided with a rib to form a limit at a position where the rear raised portion is rotated to be contacted with the motor casing; and an air guide port is provided on an upper portion of the brush head inner casing, an opening span of the air guide port along a circumferential direction have no effect on suction efficiency of the suction pipe of the brush head outer casing when the brush head inner casing rotates relative to the brush head outer casing, and an area of the air guide port is greater than an area of an inlet of the suction pipe;

wherein a front opening edge of the air guide port is configured such that when a front edge of the brush head outer casing abuts against the bottom plate, a front edge of the inlet of the suction pipe is at least flush with or does not forwards exceed the front opening edge; a rear opening edge of the air guide port is configured such that when a rear portion of the motor casing abuts against the rib, a rear edge of the inlet of the suction pipe is at least flush with or does not backwards exceed the rear opening edge.

2. The cleaning tool according to claim 1, further comprising a driving member, wherein the driving member is provided on an inner side of a side wall at an end of the brush head outer casing.

3. The cleaning tool according to claim 2, wherein, the brush head comprises a main body, and an end of the main body is provided with a transmission port matching with the driving member for driving the brush head to rotate.

4. The cleaning tool according to claim 1, wherein, an end of the brush head outer casing and a corresponding end of the brush head inner casing are each provided with a casing opening matching with a locking knob.

5. The cleaning tool according to claim 4, wherein, an operation portion of the locking knob protrudes from a side wall of the brush head outer casing.

6. The cleaning tool according to claim 1, wherein, the brush head outer casing is provided with a front edge being flush with or above or slightly below a rotation axis of the brush head.

7. The cleaning tool according to claim 1, wherein, the air guide port is provided at a middle position of the upper portion of the brush head inner casing.

8. The cleaning tool according to claim 1, wherein, an end of the suction pipe is provided with a connecting portion, and an electrical connector is provided on a periphery of the connecting portion.

9. A cleaning device, comprising a cleaning tool, wherein the cleaning tool comprises a suction pipe, a brush head outer casing, a motor casing, and a brush head;

wherein the cleaning tool further comprises:

a brush head inner casing, relatively rotatably provided within the brush head outer casing and forming an accommodation cavity of the brush head; and a bottom plate, integrally formed with the brush head inner casing and forming a cleaning contact face of the cleaning tool; wherein the bottom plate comprises a front raised portion and a rear raised portion;

an end of the rear raised portion is provided with a rib to form a limit at a position where the rear raised portion is rotated to be contacted with the motor casing; and an air guide port is provided on an upper portion of the brush head inner casing, an opening span of the air guide port along a circumferential direction have no effect on suction efficiency of the suction pipe of the brush head outer casing when the brush head inner casing rotates relative to the brush head outer casing, and an area of the air guide port is greater than an area of an inlet of the suction pipe;

wherein a front opening edge of the air guide port is configured such that when a front edge of the brush head outer casing abuts against the bottom plate, a front edge of the inlet of the suction pipe is at least flush with or does not forwards exceed the front opening edge; a rear opening edge of the air guide port is configured such that when a rear portion of the motor casing abuts against the rib, a rear edge of the inlet of the suction pipe is at least flush with or does not backwards exceed the rear opening edge.

10. The cleaning tool according to claim 1, wherein, a shape of the rear raised portion is consistent with a curved shape of the motor casing.

11. The cleaning tool according to claim 1, wherein, the rib is provided across width of the brush head.

12. The cleaning tool according to claim 6, wherein, the front edge is configured to form a limit for the front raised portion at a position where the front raised portion is rotated to be contacted with the brush head outer casing.

13. The cleaning tool according to claim 2, wherein, the driving member is provided with a driving end in a shape of a tetragonal body.

14. The cleaning tool according to claim 4, wherein, the casing opening is configured for assembly and/or disassembly of the brush head; and the locking knob is configured to lock the brush head in the casings via the casing opening.

15. The cleaning device according to claim 9, wherein the cleaning tool further comprises a driving member, wherein the driving member is provided on an inner side of a side wall at an end of the brush head outer casing.

16. The cleaning device according to claim 15, wherein, the driving member is provided with a driving end in a shape of a tetragonal body.

17. The cleaning device according to claim 9, wherein the brush head outer casing is provided with a front edge being flush with or above or slightly below a rotation axis of the brush head; and the front edge is configured to form a limit for the front raised portion at a position where the front raised portion is rotated to be contacted with the brush head outer casing.

18. The cleaning device according to claim 1, wherein the bottom plate is provided with a magnetic member used for storing the cleaning tool by adsorption.

* * * * *